US010920593B2

(12) United States Patent
Millier et al.

(10) Patent No.: US 10,920,593 B2
(45) Date of Patent: Feb. 16, 2021

(54) MOVABLE RING ASSEMBLY FOR A TURBINE ENGINE TURBINE

(71) Applicant: SAFRAN AIRCRAFT ENGINES, Paris (FR)

(72) Inventors: Vincent Francois Georges Millier, Moissy-Cramayel (FR); Francois Pierre Michel Comte, Moissy-Cramayel (FR); Fabien Stephane Garnier, Moissy-Cramayel (FR); Alain Dominique Gendraud, Moissy-Cramayel (FR); Arnaud Lasantha Genilier, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 106 days.

(21) Appl. No.: 16/339,801

(22) PCT Filed: Oct. 6, 2017

(86) PCT No.: PCT/FR2017/052746

§ 371 (c)(1),
(2) Date: Apr. 5, 2019

(87) PCT Pub. No.: WO2018/065739

PCT Pub. Date: Apr. 12, 2018

(65) Prior Publication Data

US 2020/0040735 A1 Feb. 6, 2020

(30) Foreign Application Priority Data

Oct. 7, 2016 (FR) ..... 1659685

(51) Int. Cl.
*F01D 11/02* (2006.01)
*F01D 5/06* (2006.01)
(Continued)

(52) U.S. Cl.
CPC ..... *F01D 5/066* (2013.01); *F01D 5/3069* (2013.01); *F01D 11/005* (2013.01); *F01D 11/006* (2013.01); *F05D 2260/31* (2013.01)

(58) Field of Classification Search
CPC ..... F01D 5/066; F01D 11/001; F01D 11/005; F05D 2260/31
See application file for complete search history.

(56) References Cited

U.S. PATENT DOCUMENTS 7,390,170 B2 * 6/2008 Charrier ..... F16L 23/036 415/216.1
8,662,835 B2 * 3/2014 Fachat ..... F01D 11/001 415/173.5

(Continued)

FOREIGN PATENT DOCUMENTS

EP 1264964 A1 12/2002

OTHER PUBLICATIONS

International Search Report for PCT/FR2017/052746 dated Jan. 5, 2018 [PCT/ISA/210].

(Continued)

*Primary Examiner* — Ninh H. Nguyen
(74) *Attorney, Agent, or Firm* — Sughrue Mion, PLLC

(57) ABSTRACT

A movable ring assembly (4) for a turbine engine turbine (10) that is mounted between two successive rotor discs (20*a*) and (20*b*) of said turbine (10), said rotor discs (20*a*) and (20*b*) being fixed to each other by bolting, characterised in that it comprises:—a fixing ferrule (44) fixed between the upstream (20*a*) and downstream (20*b*) discs by the bolting thereof; a part forming a movable ring (42), said part supporting radial sealing members (32) and being fixed between the upstream disc (20*a*) and the ferrule (44);—and a seal (46) interposed between said part forming the movable ring (42) and the ferrule (44).

15 Claims, 7 Drawing Sheets

(51) Int. Cl.
*F01D 5/30* (2006.01)
*F01D 11/00* (2006.01)

(56) References Cited

U.S. PATENT DOCUMENTS

| | | | | |
|---|---|---|---|---|
| 8,932,020 | B2 * | 1/2015 | Belmonte | F01D 5/066 416/198 R |
| 2010/0178160 | A1 * | 7/2010 | Liotta | F01D 11/006 415/173.7 |
| 2014/0356172 | A1 | 12/2014 | Sicard et al. | |
| 2015/0308279 | A1 | 10/2015 | Blanchard et al. | |

OTHER PUBLICATIONS

Communication dated Jun. 12, 2017 from French Patent Office in counterpart FR Application No. 1659685.

* cited by examiner

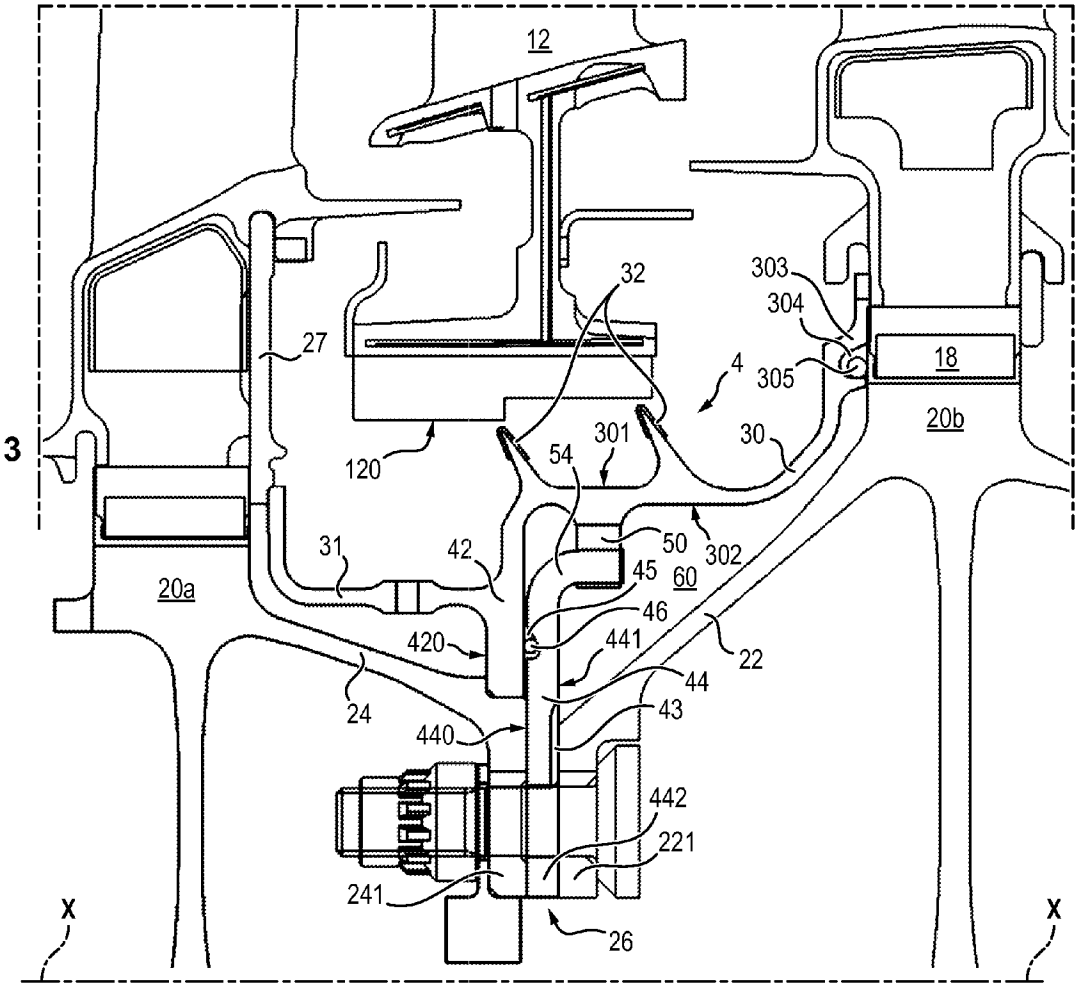
FIG. 3
FIG. 2
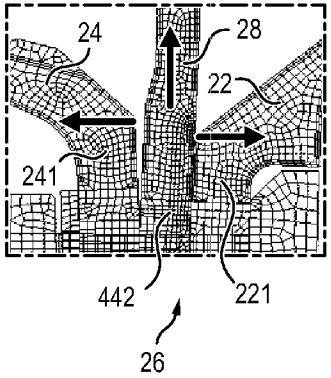

MOVABLE RING ASSEMBLY FOR A TURBINE ENGINE TURBINE

CROSS REFERENCE TO RELATED APPLICATIONS

This application is a National Stage of International Application No. PCT/FR2017/052746, filed on Oct. 6, 2017, which claims priority from French Patent Application No. 1659685, filed on Oct. 7, 2016, the entire contents of which are herein incorporated by reference in their entireties.

FIELD OF THE INVENTION

The invention relates to a movable ring assembly for a turbine engine turbine.

PRIOR ART

FIG. 1 shows an example of a portion of a turbine engine turbine known in the prior art.

The turbine 10 consists of a guide vane ring formed of a plurality of fixed vanes 12 disposed in a flow stream 14 and a movable wheel placed behind the guide vane ring and formed of a plurality of movable blades 16 also disposed in the flow stream 14 and mounted by their root in rotor disk 20*a*, 20*b*, 20*c*, 20*d*, 20*e* sockets 18.

The rotor disks 20*a*, 20*b*, 20*c*, 20*d*, 20*e* of the turbine are centered on the longitudinal axis XX and are generally assembled together by means of upstream 22 and downstream 24 ferrules which are fixed together by bolted connections 26 passing through fixing flanges 221 and 241. This assembly of disks is itself connected to a turbine shaft (not shown) to be driven in rotation.

Moreover, a movable ring 28 bearing radial sealing members 32 is disposed at the junction between each successive rotor disk, facing the corresponding fixed vane 12.

It is fixed in the bolted connection 26 and comprises a downstream retaining flange 30 bearing against the socket 18.

Some movable rings 28 can also comprise an upstream flange 31 ensuring the retention of a retaining ring 27 bearing against the bladed disk (20*a*, 20*b*) upstream of the movable ring.

The radial sealing members 32 of each movable ring 28 cooperate with the annular inner surface of the fixed blade 12 facing said ring 28 and thus ensure sealing between the upstream cavity and the downstream cavity of the turbine.

Yet, the outer annular portion of the movable ring 28 is subjected to very high temperatures due to the flow stream of hot air 14. The result is a high thermal gradient between the outer annular portion of the rings 28 and their inner annular portion. This gradient causes strong forces at the fixing flanges 221 and 241. It leads to the phenomenon called "flange opening" which reduces the life span of the turbine engine turbine rotor disks.

This phenomenon is more particularly illustrated in FIG. 2 which consists of an enlargement of the annular outer portion of the bolted connection 26 between the fixing flanges 241 of the downstream ferrule 24 of an upstream disk, 221 of the upstream ferrule 22 of a downstream disk, and 442 of the movable ring 28 disposed between the upstream disk and the downstream disk. The vertical arrow illustrates the orientation and the direction of the mechanical forces resulting from the thermal gradient in the movable ring 28 which is deforming. The result is creeping of the movable ring 28. The horizontal arrows show the opening phenomenon of the flanges 241 and 221 which goes with creeping.

DESCRIPTION OF THE INVENTION

One of the goals of the invention is to increase the life span of turbine engine turbines by limiting the flange opening phenomenon at the junction between successive rotor disks.

Another goal of the invention is to allow better mechanical strength of the junction flanges of the successive rotor disks of the turbine engine turbine subjected to strong thermal forces.

Another goal of the invention is to ensure cooling of the sockets between the rotor disks and the turbine blades.

Another goal of the invention is to ensure sealing between the upstream and downstream cavities of the turbine.

Another goal of the invention is to ensure the retention of retaining rings at the junction between the rotor blade and disk.

Another goal of the invention is to simplify the maintenance of turbine engine turbines.

In this regard, the invention has as its object a turbine engine turbine movable ring assembly which is mounted between two successive rotor disks of said turbine, said rotors disks being fixed to one another by bolts, characterized in that it comprises:

- a fixing ferrule fixed between the upstream and downstream disks, by bolting them, and
- a part forming a movable ring, said part bearing radial sealing members and being fixed between the upstream disk and the ferrule.

Advantageously but optionally, the movable ring assembly according to the invention can further comprise at least one of the following features:

- it further comprises a seal interposed between the part forming the movable ring and the ferrule,
- the movable ring is shrink-fit on the upstream disk,
- the ferrule comprises at least one lunule above the bolted connection,
- the ferrule comprises several lunules distributed periodically at a portion of a downstream tangential surface of the ferrule,
- the movable ring assembly includes a set of slots and of lugs ensuring the non-rotation of the movable ring with respect to the ferrule,
- the slots are disposed in the movable ring and the lugs extend from the ferrule,
- which the slots of the movable ring are disposed in an anti-rotation flange extending from an inner annular surface of the movable ring, and distributed periodically over an annular area of said flange distant from the inner annular surface of the movable ring,
- the lugs are distributed periodically and regularly over an outer annular surface of the ferrule, facing the corresponding slots of the anti-rotation flange of the movable ring,
- the movable ring further comprises an upstream annular flange extending from a portion of an upstream tangential surface of the movable ring and maintaining a retaining ring bearing against the upstream bladed disk
- it further comprises a retaining abutment of the movable ring, said abutment comprising a hook cooperating with a bore,
- the hook is formed on the movable ring and the bore is provided in the ferrule, and the hook is formed on the ferrule and the bore is provided in the movable ring.

The invention also has as its object a turbine engine, comprising an assembly according to the preceding description.

The proposed solution of a movable ring assembly of a turbine engine turbine makes it possible to dissociate the outer annular portion of the movable rings from the bolted connection so that the movable ring is no longer exposed to the temperature gradient. The flanges of the disks undergo strongly reduced forces and their life span is significantly increased.

In addition, the proposed solution allows retaining the initial functions of the movable rings. Indeed, the seal between the upstream cavity and the downstream cavity is ensured thanks to the sealing members. Moreover, the ventilation of the bottom of the socket of the downstream disk is still allowed thanks to the lunules formed in the annular inner portion of the ferrules. Finally, the downstream retaining flange is still bearing against the junction between the disk and the downstream blade, and, if it is present, the upstream retaining flange maintains the retaining ring bearing against the upstream bladed disk.

DESCRIPTION OF THE FIGURES

Other features, aims and advantages of the invention will be revealed by the description that follows, which is purely illustrative and not limiting, and which must be read with reference to the appended drawings in which:

FIG. 3 is a section view of one embodiment of the invention.

DETAILED DESCRIPTION OF AT LEAST ONE EMBODIMENT OF THE INVENTION

Figure 1:
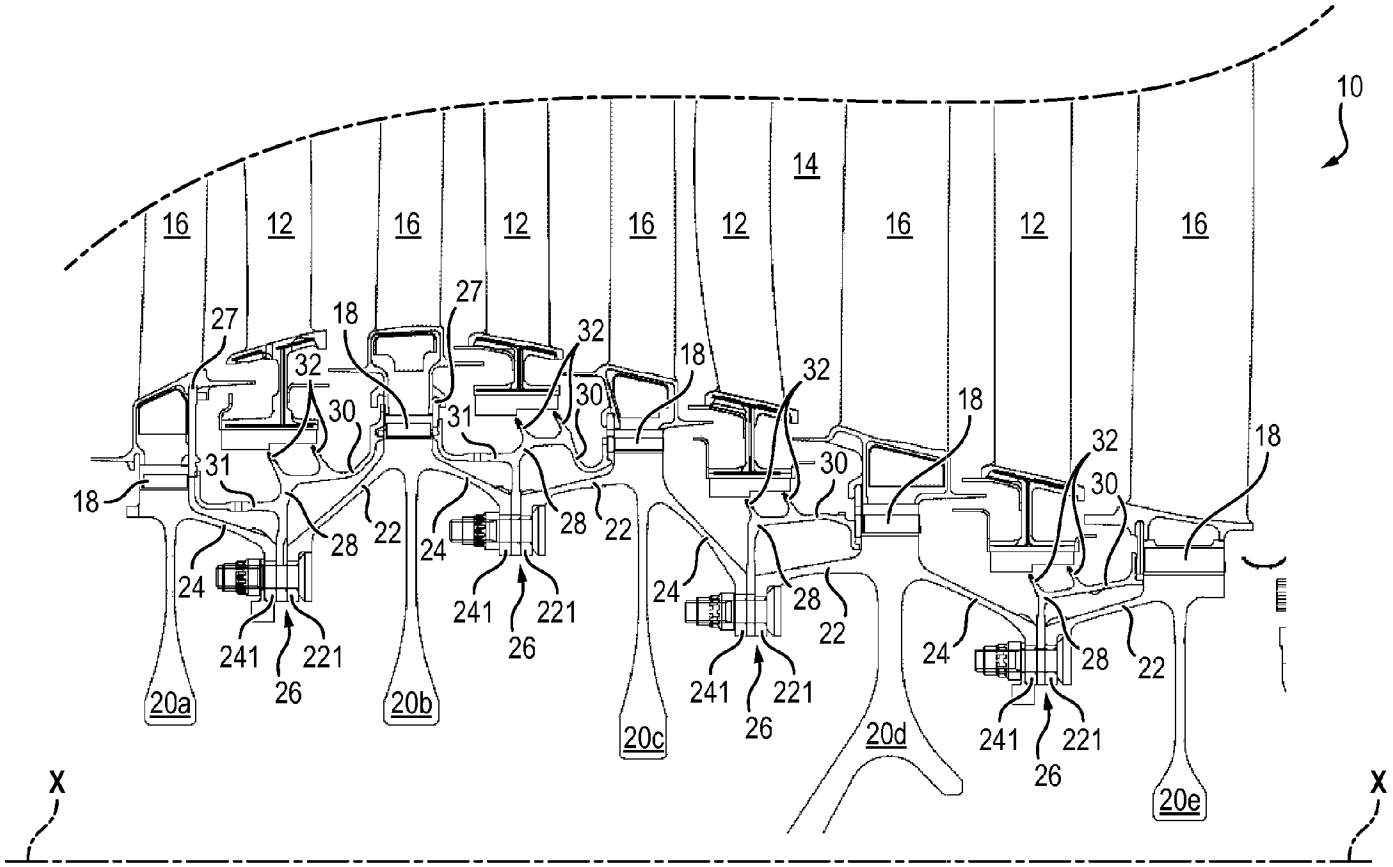
FIG. 1, already described, shows a turbine portion of a turbine engine known in the prior art, FIG. 2, also already described, illustrates a flange opening phenomenon at a bolted connection of rotor disks of a turbine engine turbine.
Figure 4A:
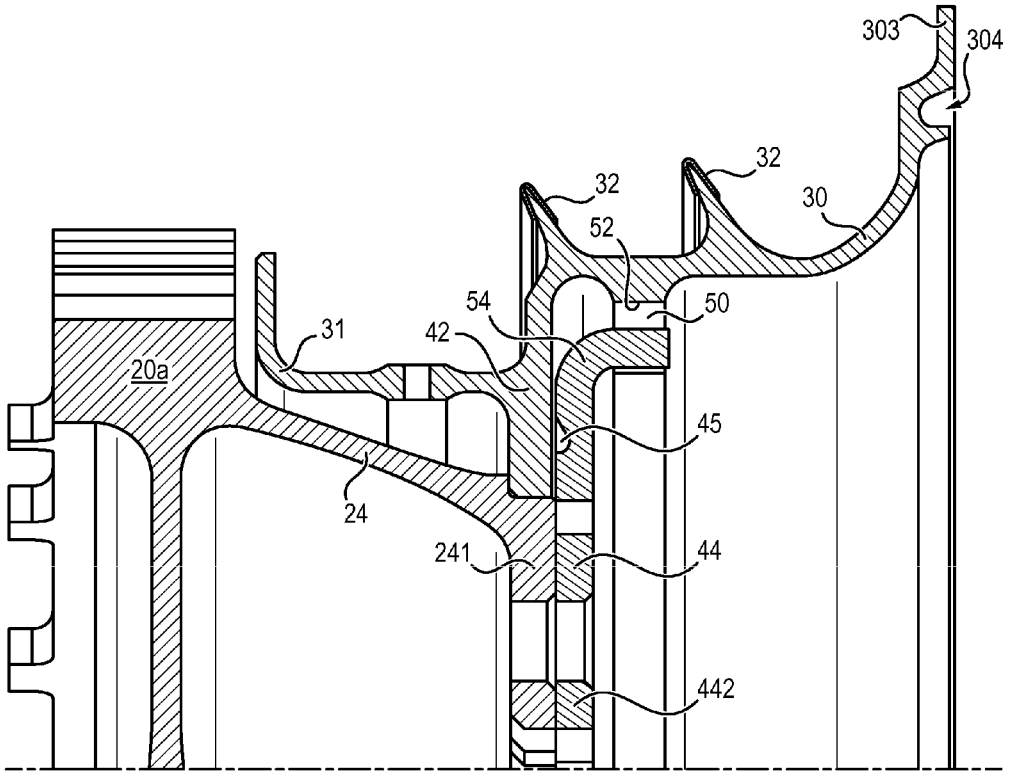
FIG. 4*a* is a perspective view of a movable ring assembly according to the invention, without showing the bolted connection and the downstream rotor disk.
Figure 4B:
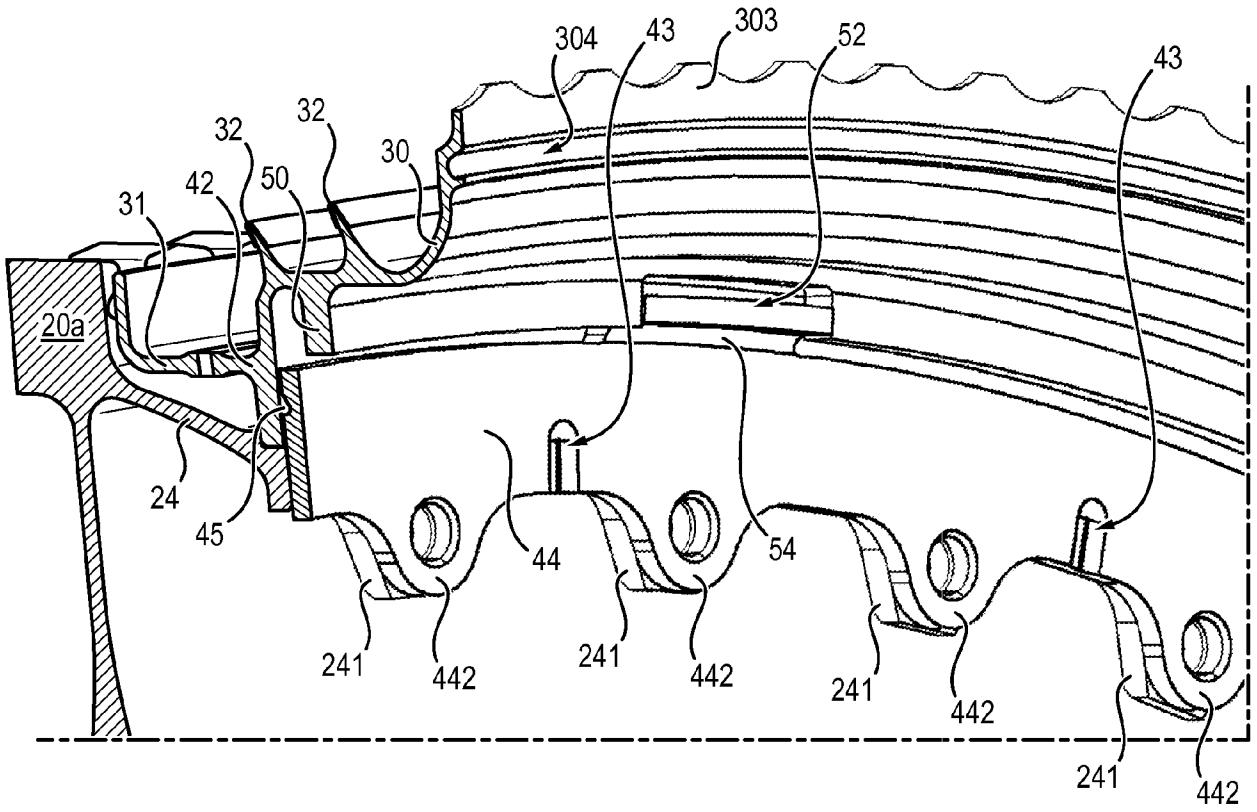
FIG. 4*b* is a view in another perspective of the same assembly as FIG. 4*a*.

Shown in FIGS. 3, 4*a* and 4*b* is a movable ring assembly 4 of a turbine engine turbine which comprises:

- a movable ring 42 with sealing members 32,
- a fixing ferrule 44 situated immediately downstream of the movable ring 42 with respect to the air flow direction in the turbine engine and
- a seal 46 interposed between the movable ring 42 and the ferrule 44.

This assembly is disposed between an upstream rotor disk 20*a* and a downstream rotor disk 20*b* and connected to them by means of a bolted connection 26.

The bolted connection 26 engages a fixing flange 442 of the ferrule 44, a fixing flange 241 of a downstream ferrule 24 extending from an annular outer portion of the upstream disk 20*a*, and a fixing flange 221 of an upstream ferrule 22 extending from an annular outer portion of the downstream disk 20*b*. This assembly ensures sealing between the upstream cavity and the downstream cavity, allows the ventilation of the disk of the downstream rotor 20*b* and maintains a retaining ring 27 bearing against the upstream bladed disk 20*a*.

At present, the different components of the assembly will be described in more detail.

Movable Ring

The movable ring 42 is a part with axial symmetry around an axis XX of the turbine engine. It comprises a downstream annular flange 30 bearing against a socket 18 of the downstream bladed rotor disk 20*b*. The outer and inner annular surfaces of this flange have been labeled 301 and 302.

The end 303 of the flange 30, bearing against the socket 18, can further comprise an annular groove 304 configured to receive an annular seal 305. Thus, during the heating of the movable ring 42 subjected to the flow of hot air, the radial dilation of the end 303 along the walls of the socket 18 does not cause a break in the seal of an air diffusion cavity 60 provided between the upstream ferrule 22 of the rotor disk 20*b*, the flange 30 and the ferrule 44. Thus, the annular seal 305 can be made of DMD0415 (HS25). The space 60 is useful in particular for the ventilation of the downstream disk 20*b*, as will be described more precisely hereafter.

Radial sealing members 32 extend from the outer surface 301. They are configured to cooperate in operation with an inner surface 120 of an annular hub bearing the fixed vanes 12 of the guide vane ring in order to ensure sealing between the upstream cavity and the downstream cavity situated on either side of the hub bearing the fixed vanes 12.

The movable ring 42 can further comprise an upstream annular flange 31 which extends from a collar 420 of the movable ring 42. This upstream annular flange bears against the retaining ring 27 so as to retain it against the upstream bladed disk 20*a*. The retaining ring 27 has as its function to axially retain the movable blades 16.

The movable ring 42 is shrinkfit, at its base, to the downstream ferrule 24 of the upstream rotor disk 20*a*.

The connection between the movable ring 42 and the upstream rotor disk 20*a* can also be used for preventing the rotation of the different parts of the assembly 4 with respect to one another.

Finally, the movable ring 42 includes an annular flange called the anti rotation flange 50 extending radially inward from the radial inner annular surface 302 of the ring, and having a series of slots 52 extending radially inward, periodically, around the entire flange 50. The function of the flange 50 and of the slots 52 will be detailed hereafter.

Ferrule

The ferrule 44 comprises on its upstream surface (surface 440) a circumferential groove 45 configured to accommodate the annular seal 46. This seal is put into compression between the collar 420 of the movable ring 42 and the ferrule 44 by the bolted connection 26. Thus, in the event of loss of the connection between the movable ring 42 and the downstream ferrule 24 of the upstream rotor disk 20*a*, the seal 46 provides continuity of sealing between the upstream and downstream cavities of the turbine. Moreover, inasmuch as the seal 46 is located at the interface between two parts with very different temperatures, it is now itself that is subjected to a strong thermal gradient. Consequently, the seal 46 can be made of DMD0415 (HS25).

Moreover, the ferrule 44 also has, on the downstream side (surface 441) one or more cooling lunules 43 disposed above the bolted connection 26, for example a series of circumferential lunules 43 regularly distributed at a portion of the downstream tangential surface 441.

These lunules 43 allow a circulation of cool air collected upstream of the turbine and circulating through each bolted connection 26. This cool air circulating from upstream of the turbine is able to pass through the lunule 43 to the air diffusion cavity 60 before diffusing into each socket 18 of the disk 20*b* to ventilate them.

The fixing ferrule 44 terminates below said lunules 43 by a fixing flange 442 which is configured to allow the fixing of the ferrule 44 in the bolted connection 26. To this end, the flange 442 has a series of openings distributed periodically and intended to face a series of similar openings made respectively in the flanges 241 and 221 of the downstream ferrules 24 of the upstream disk 20*a* and upstream 22 of the downstream disk 20*b*.

Anti-Rotation

At its opposite end, the ferrule 44 can comprise a series of antirotation lugs 54 which extend protruding with respect to the rest of said ferrule 44. These lugs are space periodically all around the ferrule 44 so as to be facing slots 52 which the flange 50 of the movable ring 42 (FIGS. 4*a* and 4*b*) has.

The slots 52 and lugs 54 are configured to each cooperate with one another all around the ring 42 and the ferrule 44 respectively. They therefore have substantially complementary shapes.

The movable ring 42 being dissociated from the bolted connection 26, these slots 52 and lugs 54 ensure the blockage in rotation of the different parts and the mechanical cohesion of the assembly 4.

In addition to stopping rotation, the slotlug system described above can ensure the centering of the ring 42 in the assembly 4 in the event of loss of shrink-fit of the ring 42.

Alternatively or in addition, stopping rotation can be allowed by a slotlug system provided in the interface between the movable ring 42 and the downstream ferrule 24 of the upstream disk 20*a*. In this embodiment, the annular flange 50 is shrinkfit on the outer annular portion of the ferrule 44.

Retention of the Movable Ring

Figure 5A:
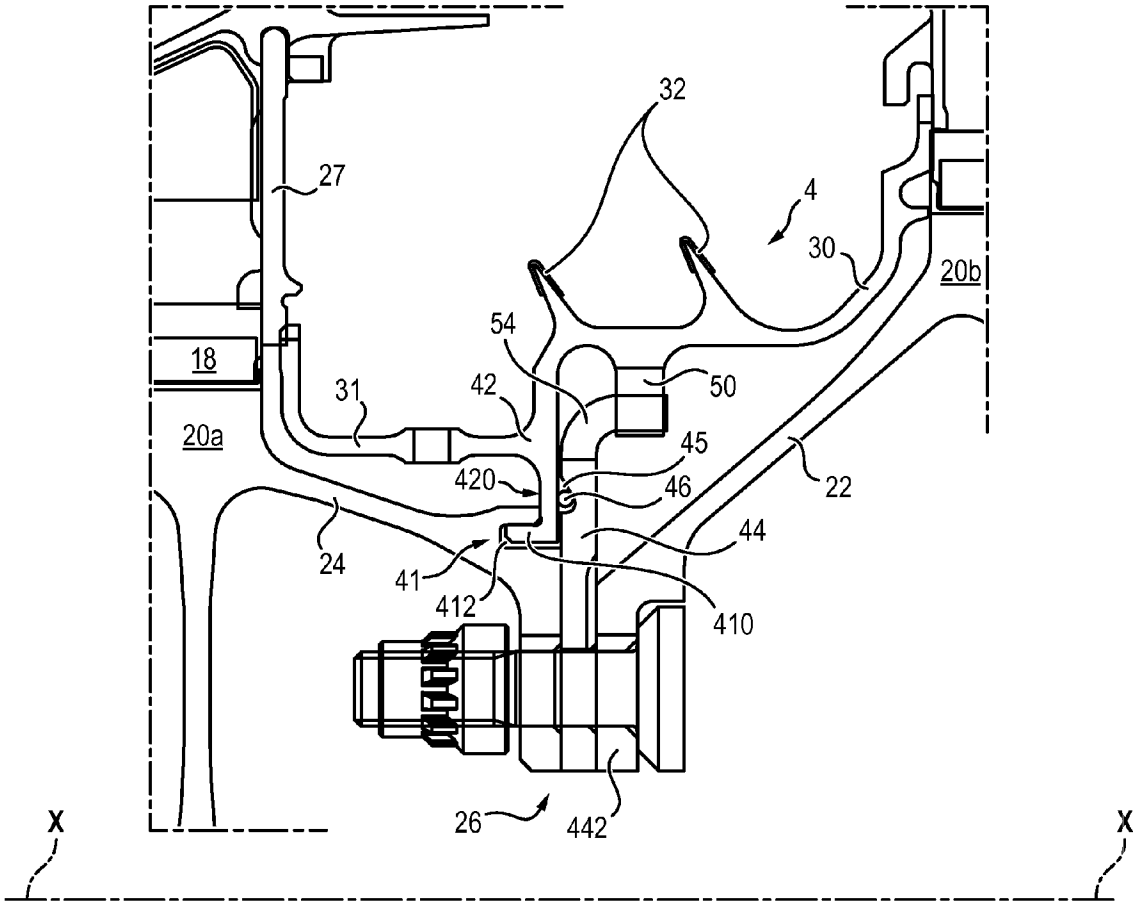
FIG. 5*a* is a section view of a first exemplary embodiment of the assembly according to the invention comprising a retaining abutment.
Figure 5B:
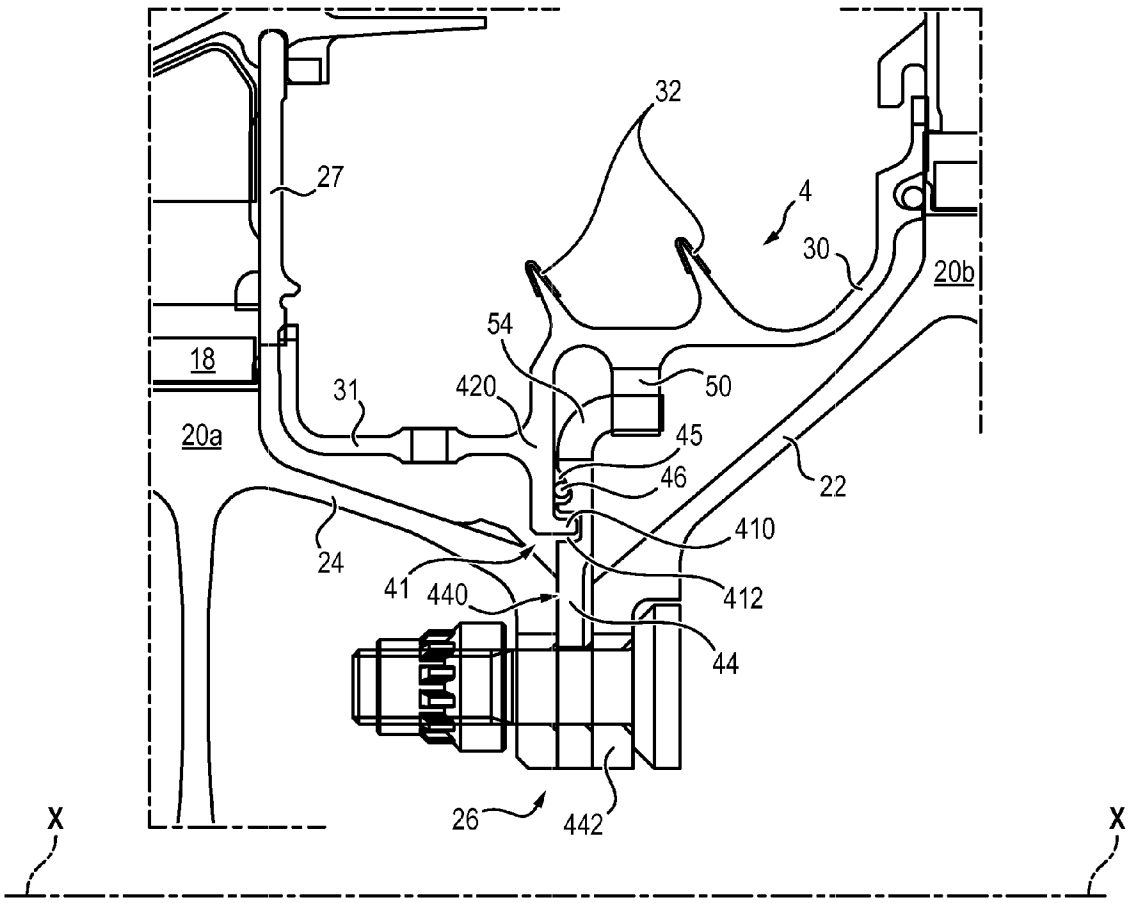
FIG. 5*b* is a section view of a second embodiment of the assembly according to the invention comprising a retaining abutment.
Figure 5C:
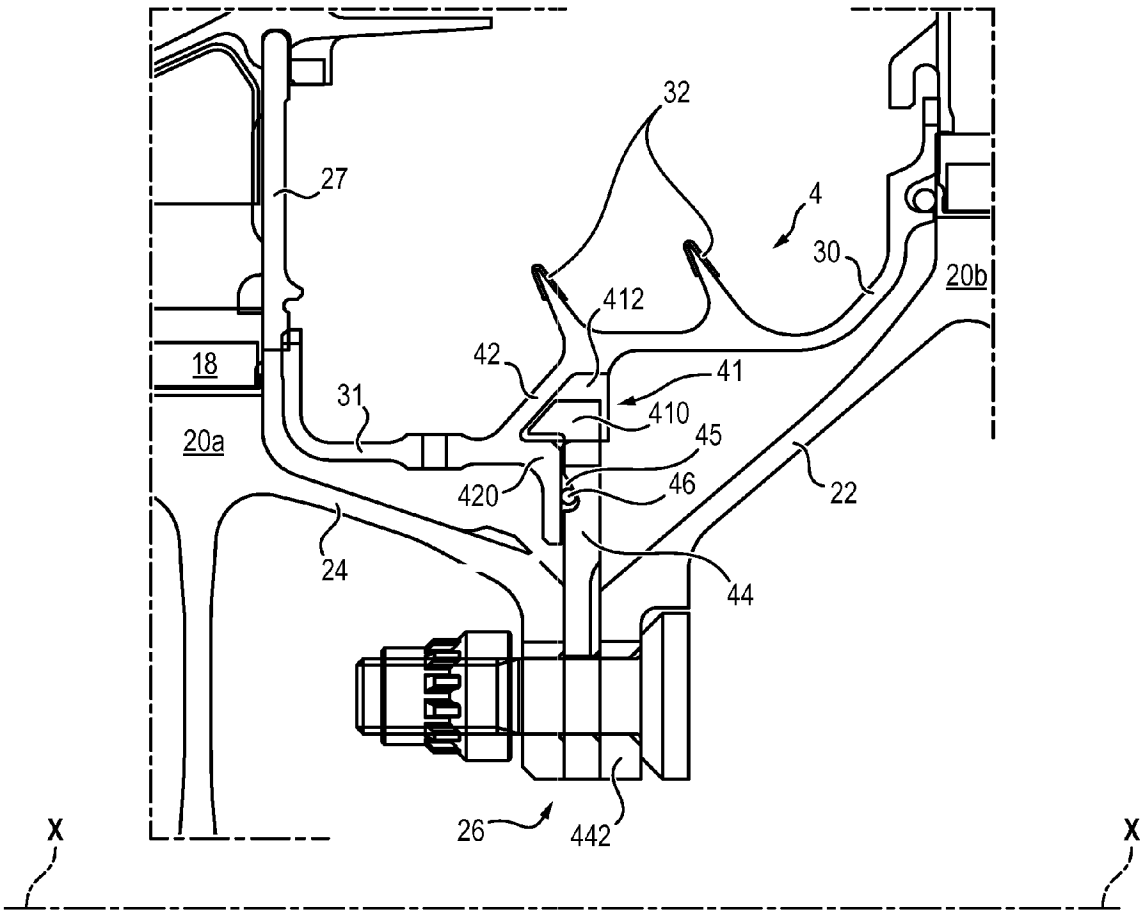
FIG. 5*c* is a section view of a third exemplary embodiment of the assembly according to the invention comprising a retaining abutment.

In one embodiment illustrated in FIGS. 5*a* to 5*c*, the assembly 4 further comprises a retaining abutment 41 configured to ensure the stability of the movable ring 42 during operation, particularly in the event of loss of shrinkfit of the ring 42. Indeed, the assembly 4 undergoes large centrifugal forces due to the rotation of the movable wheel. It is therefore essential to guarantee the mechanical cohesion of the assembly 4, regardless of operating conditions.

As illustrated in FIG. 5*a*, the retaining abutment 41 can take the form of a hook 410 formed by the lower end of the ring 42, and extending upstream so as to cooperate with a bore 412, with a shape complementary to that of the hook 410, and provided in the downstream end of the downstream ferrule 24.

Alternatively, as illustrated in FIG. 5*b*, the hook 410 cooperates with a bore 412 provided in the upstream portion 440 of the ferrule 44, for example below the circumferential groove 45 accommodating the seal 46.

Alternatively, as illustrated in FIG. 5*c*, the hook 410 is formed by the upper end of the ferrule 44, and also extends upstream so as to cooperate with a bore 412, with a shape complementary to that of the hook 410, and provided in the downstream portion of the collar 420 of the ring 42.

The shape and the dimensions of the hook 410 and of the bore 412 can vary depending on the intensity of the retention desired, but also on considerations of easy of assembly, for example for maintenance. It is thus possible to dimension the bore 412 slightly larger than the hook 410, so as to leave an operating margin before the contacting of the abutment 41 so as not to pull immediately on the flange 442.

In addition, the hook 410 can advantageously be shrinkfit in the bore 412, so as to favor the retention offered by the abutment 41.

Moreover, the retaining abutment 41 can also comprise several hooks 410 formed on the ring 42 or the ferrule 44, and cooperating with several corresponding bores 412.

Finally, the hook 410 and the bore 412 can be formed with axial symmetry around the longitudinal axis XX, or only be formed on successive angular portions, equally spaced or not, around the longitudinal axis XX.

Thanks to the retaining abutment 41, the assembly 4 is made more robust, in particular in the event of loss of shrinkfit of the movable ring 42.

Mechanical Strength and Increase of Life Span

The proposed assembly therefore allows an increase in the life span of the turbine engine turbine by reducing the flange opening phenomenon at the bolted connection which connect the different disks of the turbine rotor.

In fact, during the flow of hot air in the turbine 10, the movable ring 42 will be heated. Inasmuch as there is no more mechanical continuity between the movable ring 42 and the bolted connection 26, only the movable ring 42 will dilate. Consequently, the outer annular portion of the fixing ferrule 44 will no longer "pull" on the flange 442 and will therefore not cause high forces on the other flanges 221 and 241 of the bolted connection 26.

Consequently, the mechanical strength of the bolted connections 26 of the turbines 10 of turbine engines comprising an assembly of the type of the assembly 4 which was just described is improved. The result is an increase in their life span.

The invention claimed is:

1. A movable ring assembly which is mounted between an upstream rotor disk and a downstream rotor disk of a turbine engine turbine, the upstream rotor disk being fixed to the downstream rotor disk by bolts, the movable ring assembly comprising:

a ferrule fixed between the upstream rotor disk and the downstream rotor disk by bolting the upstream rotor disk, the ferrule and the downstream rotor disk together, and a part forming a movable ring and bearing radial sealing members, the movable ring being fixed between the upstream rotor disk and the ferrule without bolting the upstream rotor disk, the movable ring and the ferrule together.

2. The movable ring assembly according to claim 1, further comprising a seal interposed between the movable ring and the ferrule.

3. The movable ring assembly according to claim 1, wherein the movable ring is shrink-fit on the upstream rotor disk.

4. The movable ring assembly according to claim 1, wherein the ferrule comprises at least one lunule above the bolted connection.

5. The movable ring assembly according to claim 4, wherein the ferrule comprises several lunules distributed regularly at a portion of a downstream tangential surface of the ferrule.

6. The movable ring assembly according to claim 1, including a set of slots and of lugs ensuring the non-rotation of the movable ring with respect to the ferrule.

7. The movable ring assembly according to claim 6, wherein the slots are disposed in the movable ring and the lugs extend from the ferrule.

8. The movable ring assembly according to claim 7, wherein the slots of the movable ring are disposed in an anti-rotation flange extending from an inner annular surface of the movable ring, and distributed periodically over an annular area of said flange distant from the inner annular surface of the movable ring.

9. The movable ring assembly according to claim 8, wherein the lugs are distributed periodically and regularly over an outer annular surface of the ferrule, facing the corresponding slots of the anti-rotation flange of the movable ring.

10. The movable ring assembly according to claim 1, wherein the movable ring further comprises an upstream annular flange extending from a portion of an upstream tangential surface of the movable ring and maintaining a retaining ring bearing against the upstream rotor disk.

11. The movable ring assembly according to claim 1, further comprising a retaining abutment of the movable ring, said retaining abutment comprising a hook cooperating with a bore.

12. The movable ring assembly according to claim 11, wherein the hook is formed on the movable ring and the bore is provided in the ferrule.

13. The movable ring assembly according to claim 11, wherein the hook is formed on the ferrule and the bore is provided in the movable ring.

14. A turbojet comprising the movable ring assembly according to claim 1.

15. A movable ring assembly which is mounted between an upstream rotor disk and a downstream rotor disk of a turbine engine turbine, the upstream rotor disk being fixed to the downstream rotor disk by bolts, the movable ring assembly comprising:

a ferrule fixed between the upstream rotor disk and the downstream rotor disk by bolting the upstream rotor disk, the ferrule and the downstream rotor disk together;

a part forming a movable ring and bearing radial sealing members, the movable ring being fixed between the upstream rotor disk and the ferrule; and a seal interposed between the movable ring and the ferrule.

* * * * *